United States Patent [19]

Yagasaki et al.

[11] Patent Number: 4,744,257

[45] Date of Patent: May 17, 1988

[54] KICK TYPE STARTING DEVICE FOR ENGINE

[75] Inventors: Akio Yagasaki; Kenji Yamane, both of Tokyo, Japan

[73] Assignee: Honda Giken Kogyo Kabushiki Kaisha, Tokyo, Japan

[21] Appl. No.: 26,594

[22] Filed: Mar. 17, 1987

[30] Foreign Application Priority Data

Mar. 18, 1986 [JP] Japan ..... 61-60402
Mar. 20, 1986 [JP] Japan ..... 61-63367

[51] Int. Cl.[4] ..... F02N 3/04; F02N 15/06

[52] U.S. Cl. ..... 74/6; 74/133; 123/185 CA

[58] Field of Search ..... 74/6, 133; 123/179 SE, 123/185 C, 185 CA; 192/42

[56] References Cited

U.S. PATENT DOCUMENTS 4,096,842 6/1978 Kurata ..... 74/6 X

FOREIGN PATENT DOCUMENTS 532098 8/1955 Italy ..... 123/185 C
60/34563 3/1985 Japan .
10165 of 1913 United Kingdom ..... 74/6
809274 2/1959 United Kingdom ..... 123/185 CA
853377 11/1960 United Kingdom ..... 123/185 C

*Primary Examiner*—Allan D. Herrmann
*Attorney, Agent, or Firm*—Lyon & Lyon

[57] ABSTRACT

A kick type starting device for an engine, comprising a drive clutch body operatively connected to a kick axle of a kick pedal such that when the kick pedal is actuated engaging thrust and rotary torque are given to the driving clutch body, and a driven clutch body provided on an engine crank shaft and brought into engagement with the driving clutch body when the latter is advanced by the engaging thrust, wherein when the kick pedal returns to its resting position in a state where the driving and driven clutch bodies are engaged, a cam mechanism provided between the kick axle and the driving clutch body is actuated to cause the driving clutch body to be disengaged from the driven clutch body so as to cut the transmission of the reverse torque from the crank shaft to the kick axle.

1 Claim, 8 Drawing Sheets

KICK TYPE STARTING DEVICE FOR ENGINE

BACKGROUND OF THE INVENTION

1. Field of the Invention:

The present invention relates to a kick type starting device adopted in a motorcycle or the like, and particularly to an improvement in a kick type starting device comprising a kick axle provided with a kick pedal, a driving clutch body operatively connected to said kick axle so that when said kick pedal is kicked engaging thrust and rotary torque are given to the driving clutch body, and a driven clutch body provided on a crank shaft of the engine and placed in engagement with said driving clutch body when the latter is advanced by said engaging thrust.

2. Description of the Prior Art:

Such a starting device is already known, for example, by the disclosure of Japanese utility model laid open No. 60-34563 (34563/1985).

In such a prior starting device, even if the kick pedal is kicked, when the crank shaft has no surplus force which would permit the shaft to exceed its upper dead center, overload may be imparted to each portion of the starting device by means of the crank shaft rotating in reverse direction with a pressure of detonating gas, according to its ignition timing.

SUMMARY OF THE INVENTION

The present invention is made in the light of such circumstances, and it is an object of the present invention to provide a kick type starting device which is not subject to the overload even if the crank shaft is rotated reversely by the starting miss as mentioned above.

In order to attain the above object, according to the present invention, it is proposed that a cam mechanism is provided between said kick axle and said driving clutch body, said cam mechanism being adapted to cause said driving clutch body to be disengaged from said driven clutch body when said kick pedal is actuated to return to its resting position in engaging conditions of said driving and said driven clutch bodies.

With the above described arrangement, even if the crank shaft is reversely rotated by an operator's starting miss, the driving clutch body is disengaged from the driven clutch body during returning motion of the kick pedal by the operation of the cam mechanism. Therefore, the reverse torque of the crank shaft is effectively prevented from being transmitted to the side of the kick axle and generation of any overload due to such reverse torque is avoided, contributing to reduction in weight and improvement in durability of a starting device.

In the above described arrangement, if the cam mechanism is constructed to include a release plate connected to the driving clutch body and a release cam connected to the kick axle and if the release cam is formed into a shape of disc and is rotatably supported by the kick axle, the friction resistance can be made small at the time of engagement of the release cam with the release plate to allow an efficient application of the thrust to the release plate in its retracting direction so that the driving clutch body can efficiently be disengaged from the driven clutch body.

Further, in the above described arrangement, if a cam surface of the release cam is formed so as to have its engaging angle with respect to said release plate increasing in response to an increasing depth of engagement of the release cam with the release plate, the cam surface of the release cam first starts to engage with the release plate at a relatively small angle and the engaging angle increases correspondingly to the increasing depth of their engagement. Therefore, the driving clutch body can be disengaged from the driven clutch body without shock and in much better efficiency.

The above and other objects, features and advantages of the present invention will be apparent from the description of preferred embodiments which will be made in detail hereinafter in connection with the accompanying drawings.

BRIEF DESCRIPTION OF THE DRAWINGS

FIGS. 1 to 3 show a first embodiment of the present invention wherein FIG. 1 is a longitudinal cross sectional plan view showing a kick type starting device for a motorcycle engine; FIG. 2 is a cross sectional view taken along line II—II of FIG. 1; and FIG. 3 is a view explaining function of the cam mechanism.

FIGS. 5 to 8 show a third embodiment of the present invention wherein FIG. 5 is a longitudinal cross sectional plan view, similar to FIG. 1; FIG. 6 is an enlarged view of an essential portion of FIG. 5; FIG. 7 is a view explaining function of the cam mechanism; and FIG. 8 is a characteristic diagram of the cam mechanism.

DESCRIPTION OF PREFERRED EMBODIMENTS

The present invention will be decribed below with respect to some embodiments applied to a starting device for a motorcycle engine while referring to the attached drawings.

Figure 1:
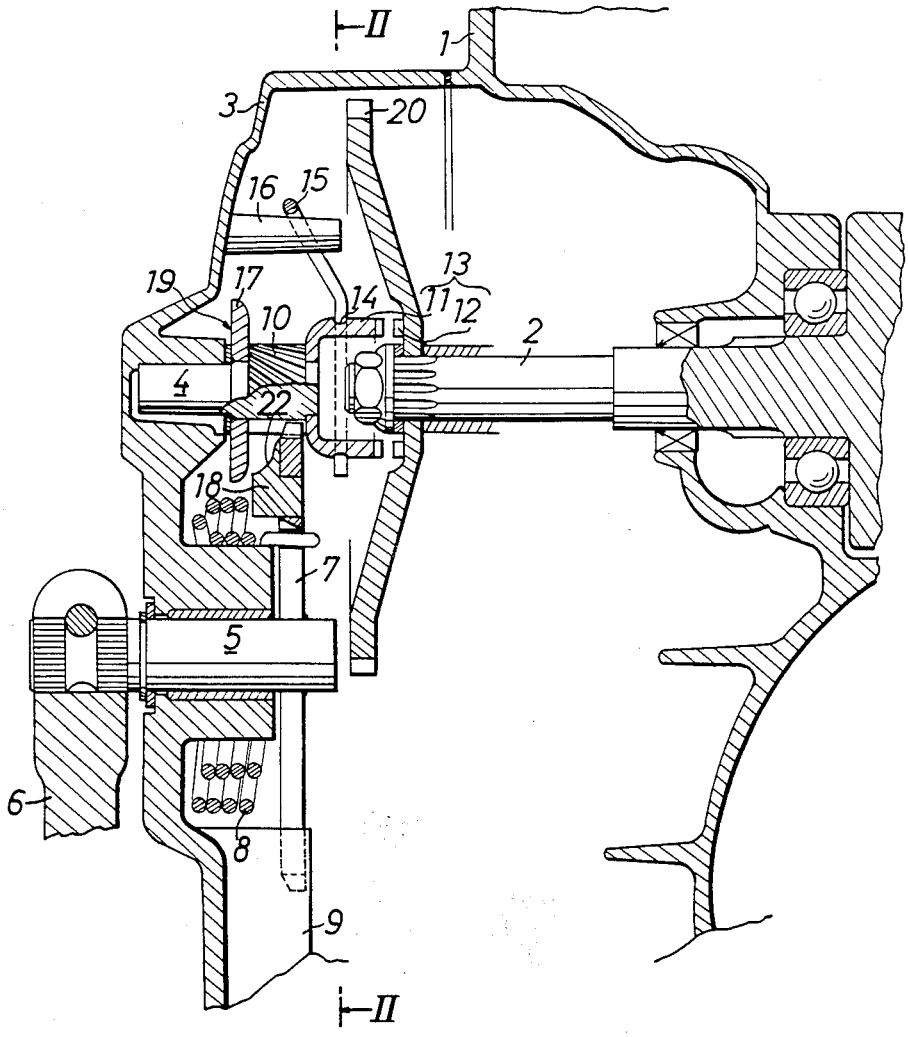
Figure 2:
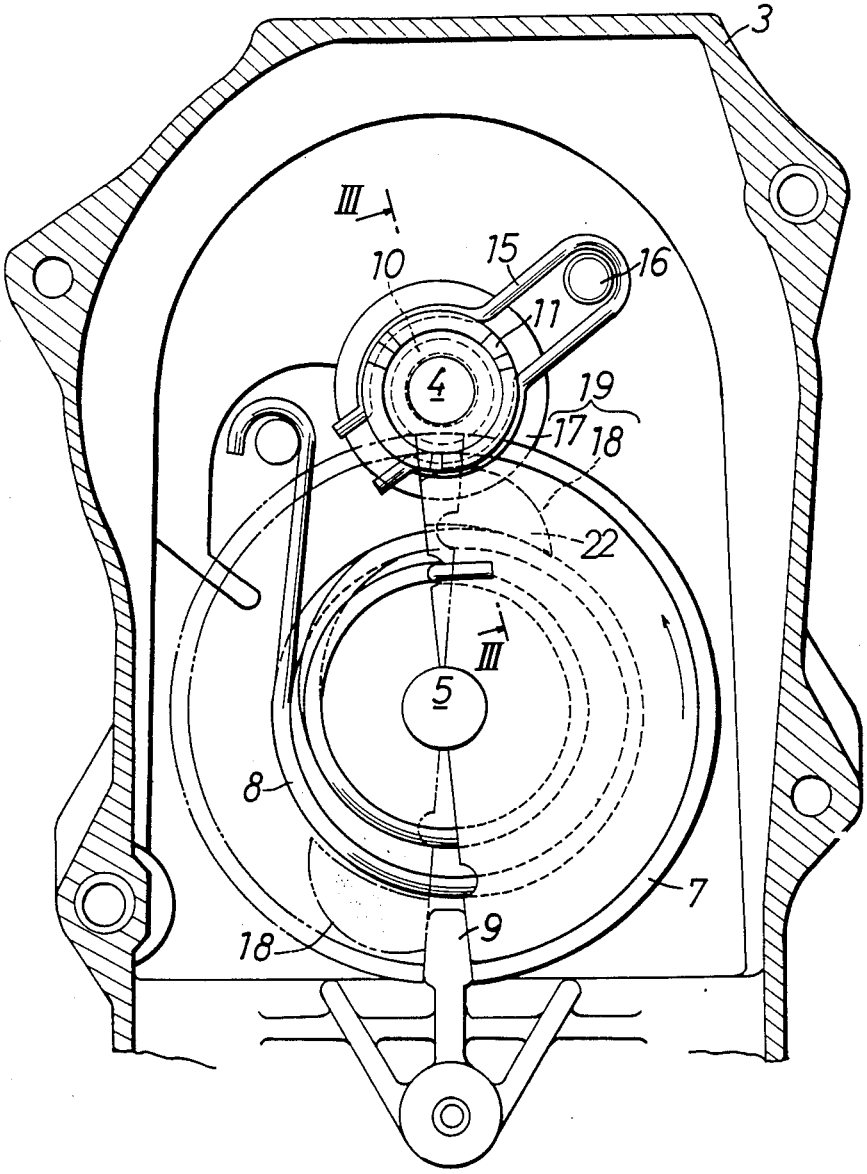
Figure 3:
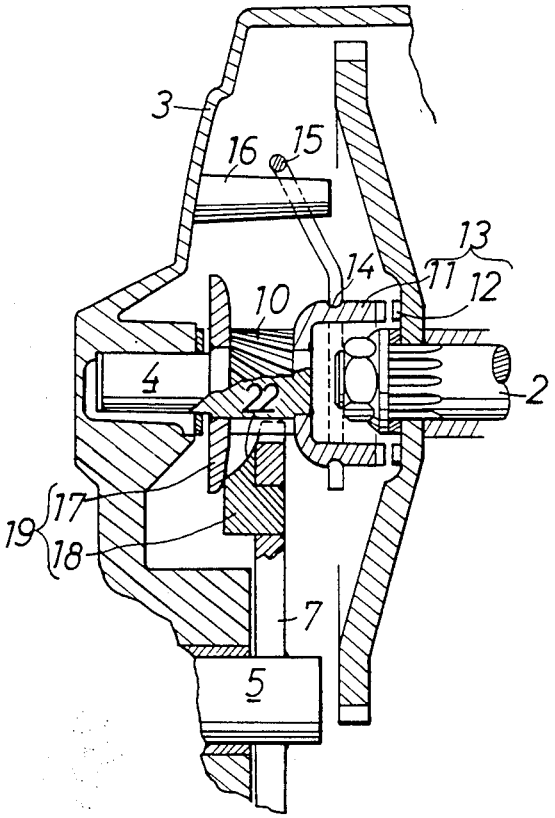

Description will first be made of a first embodiment of the present invention shown in FIGS. 1 to 3. In FIGS. 1 and 2, a crank shaft 2 is rotatably supported in a crank case 1 of an engine and is arranged on the same axis as that of a starting shaft 4 rotatably and slidably supported in a side cover 3 adjoined to one side surface of the crank case 1, in such a manner that the crank shaft 2 and the starting shaft 4 have their end faces opposed to each other. A kick axle 5 is rotatably supported in the side cover 3 parallel to the crank shaft 2 and the starting shaft 4.

To the kick axle 5 are fixed a kick pedal 6 at an outside of the side cover 3 and a sector shaped driving gear 7 having a large diameter at an inside of the side cover 3. Also, to the kick axle 5 is connected a return spring 8 of torsion coil type which urges the kick axle 5 to rotate toward a resting position of the kick pedal 6. The resting position of the pedal is defined by one end face of the driving gear 7 abutting against a stopper 9 projected on an inner wall of the side cover 3. A kicking limit of the pedal 6 is also determined by the other side face of the driving gear 7 to abut against the stopper 9.

On the starting shaft 4 is formed a driven gear 10 having a small diameter meshing with the driving gear 7. These gears 7 and 10 are so arranged that the driven gear 10 is driven from the driving gear 7 in the direction of a normal rotation of the crank shaft 2 when the kick pedal 6 is kicked in a direction of an arrow shown in FIG. 2. The gears are further formed in a helical shape in order that the driving gear 7 gives the driven gear 10 a thrust acting to the side of the crank shaft 2 when the kick pedal 6 is operated as mentioned above.

To that end of the starting shaft 4 which is near the crank shaft 2 is welded a cup shaped driving ratchet 11 as a driving clutch body. On the crank shaft 2 is fixed a driven ratchet 12 as a driven clutch body to oppose the driving rachet 11. These ratchets 11, 12 are constructed so that when they engage the driving ratchet 11 can drive the driven ratchet 12 in the direction of normal rotation of the crank shaft 2, however, when the driven ratchet 12 acts on the driving ratchet 11 to drive it, these ratchets affect separating forces to each other. A starting clutch 13 is constituted by these ratchets 11, 12.

On an outer periphery of the starting shaft 4 is formed an annular groove 14 in which a pincers-formed spring 15 is engaged with friction. A base end of the pincers-formed spring 15 is slidably engaged to a supporting stud 16 which is projected from the inner wall of the side cover 3 in parallel to the starting shaft 4. Accordingly, this pincers-formed spring 15 is capable of displacing in the axial direction together with the driving ratchet 11 and at the same time gives a required rotative resistance to the ratchet 11.

A circular release plate 17 is fixed to the starting shaft 4 on its outer peripheral face adjacent the driven gear 10. A release cam 18 having a cam surface 22 thereon is secured on one side face of the driving gear 7 so as to cooperate with the release plate 17. The release cam 18 is adapted to engage the release plate 17 at the cam surface 22 to cause the starting shaft 4 to retract to the side opposite to the crank shaft 2, when the kick pedal 6 is actuated to return and come to a position near the resting position with the driving ratchet 11 engaging the driven ratchet 12. A cam mechanism 19 is constituted by the release plate 17 and the release cam 18.

In FIG. 1, reference numeral 20 shows a ring gear driven by a starting motor (not shown) through the intermediary of pinion gear.

A description will be made in the following about the operation of this embodiment.

When the kick pedal 6 is kicked to start the engine and the kick axle 5 is rotated in the arrow direction of FIG. 2, the driving gear 7 rotates simultaneously and drives the driven gear 10. Then because the driving ratchet 11 which is integral with the driven gear 10 and the starting shaft 4 is subject to the rotative resistance from the pincer spring 15, the starting shaft 4 advances to the side of the crank shaft 2 due to the engaging thrust occurring to the meshing portions of the helical type gears 7, 10. Then, the driving ratchet 11 engages the driven ratchet 12, that is, it brings the starting clutch 13 into a connected state. Thereafter, the driving gear 7 rotatingly drives the driven gear 10 while generating slips between the pincers-formed spring 15 and the driving ratchet 11, so that the rotary force of the gear 10 is transmitted to the crank shaft 2 through the intermediary of the starting clutch 13 in a connected state. By cranking the crank shaft 2 in this manner, the engine is started.

However, when the engine is not started by the kicking operation of the kick pedal 6 and a reverse torque is generated on the crank shaft 2, the reverse torque is transmitted to the starting shaft 4, the driven gear 10, the driving gear 7, the kick axle 5 and the kick pedal 6 through the intermediary of both clutch bodies lying in their connected state thereby to rotate them in a reverse direction toward the resting position. Then, immediately before the driving gear 7 reaches its position abutting against the stopper 9, that is, its resting position, the release cam 18 rotating together with the driving gear 7 comes to engagement with the release plate 17 as shown in FIG. 3 and causes the latter to retract together with the starting shaft 4 in the direction away from the crank shaft 2, whereby the driving ratchet 11 is disengaged from the driven ratchet 12. Accordingly, before the driving gear 7 abuts against the stopper 9, the starting device is released from the reverse torque of the crank shaft 2, and overload which would be generated by the driving gear 7 abutting intensely against the stopper 9 can be prevented from occurring.

When the engine is started, the driven ratchet 12 integral with the crank shaft 2 rotates at a faster speed than the driving ratchet 11. Accordingly, the driven ratchet 12 pushes back the driving ratchet 11 so as to disengage therefrom, assuring that the rotation of the crank shaft 2 in a normal direction is not transmitted to the starting shaft 4.

After starting, if the kick pedal 6 is released, the driving gear 7 is rotated reversedly by the force of the return spring 8. Accordingly, the driven gear 10 retracts together with the starting shaft 4 through the action opposite to that of the starting operation, so that the driving ratchet 11 can fully be disengaged from the driven ratchet 12.

Figure 4:
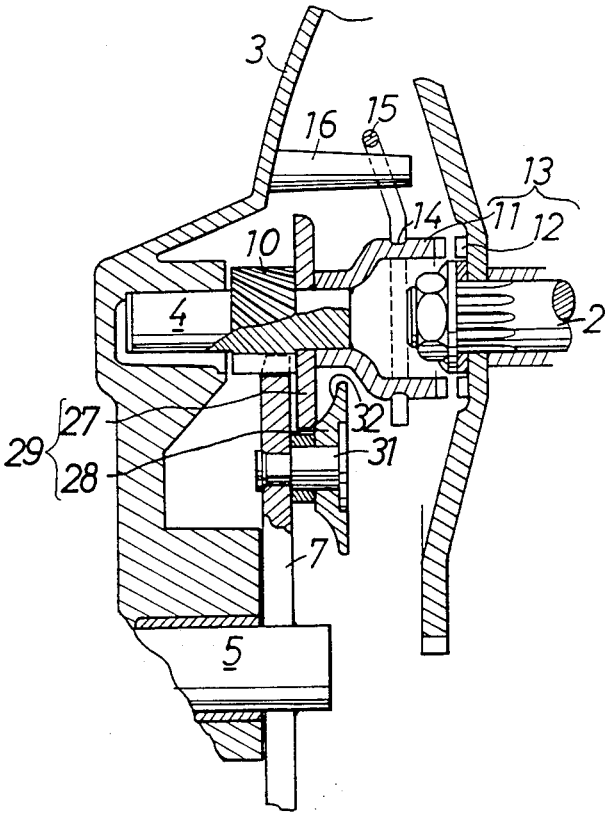
FIG. 4 is a cross sectional view partially showing a cam mechanism according to a second embodiment of the present invention.
Figure 5:
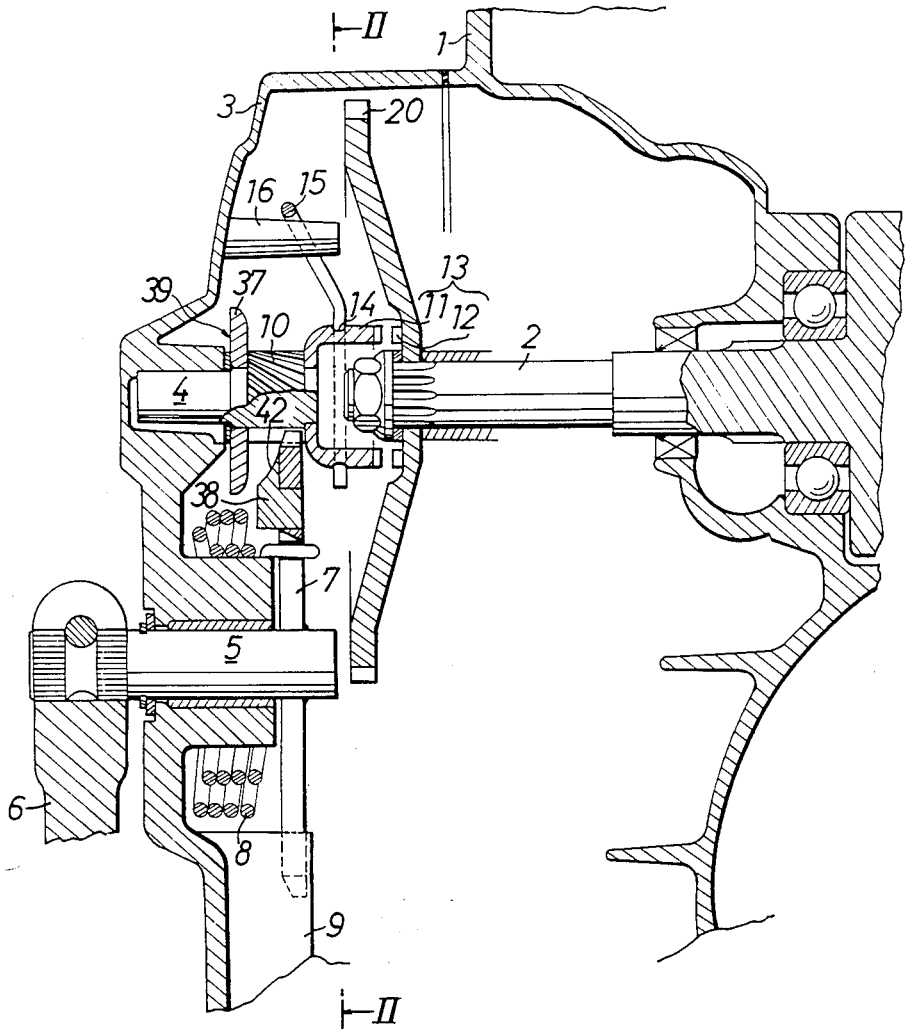

FIG. 4 shows a second embodiment of the present invention having substantially the same structure as that of the previous first embodiment, except that a release cam 28 of a cam mechanism 29 is formed into a disc shape and is rotatably supported at 31 on an end face of the driving gear 7 on the crank shaft 2 side and that the release plate 27 is secured to the outer peripheral face of the starting shaft 4 at an inner position than the driven gear 10. In FIG. 4, parts corresponding to those of the previous embodiment except the cam mechanism 29 are indicated by the same reference numerals as those used in the embodiment.

According to the second embodiment, since the release cam 28 is formed rotatable, the friction resistance encountered when it engages the release plate 27 is small whereby the thrust acting in the retracting direction can be given to the release plate 27 in good efficiency and therefore, the disengagement of the driving ratchet 11 from the driven ratchet 12 can be carried out more efficiently.

FIGS. 5 to 8 show a third embodiment of the present invention, which differs from the first embodiment only in the shape of a release cam 38 of a cam mechanism 39. Therefore, description of the construction other than the cam mechanism 39 will be omitted. In those figures, parts corresponding to those of the previous embodiments except the cam mechanism 39 are indicated by the same reference numerals.

Figure 6:
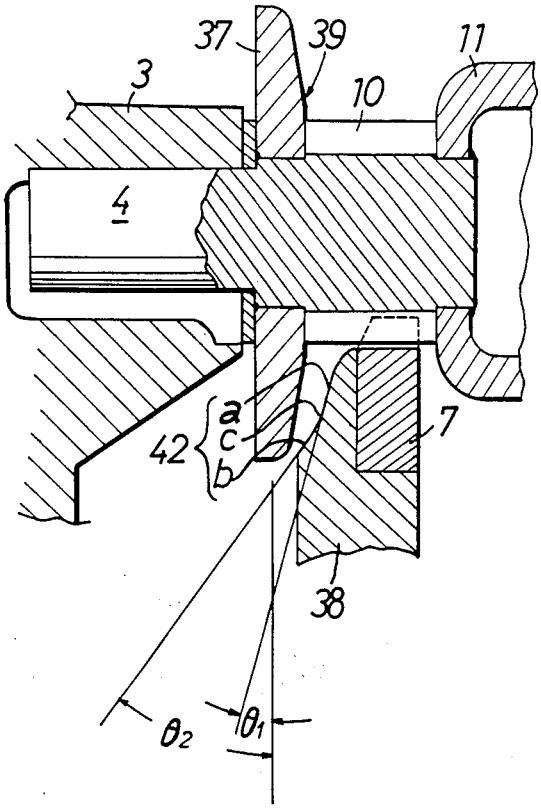

As shown in FIG. 6, a cam surface 42 of the release cam 38 is formed tapered so as to come closer to the release plate 37 at its center. The cam surface 42 is designed to have a loose slant surface a on the outer periphery side half portion and a sharp slant surface b on the inner periphery side half portion. An engaging angle $\theta_2$ of the sharp slant surface b with respect to the release plate 37 is formed larger than an engaging angle $\theta_1$ of the loose slant surface a with respect to the plate 37. These slant surfaces a, b are adjoined together smoothly via a concave curved surface c.

Figure 7:
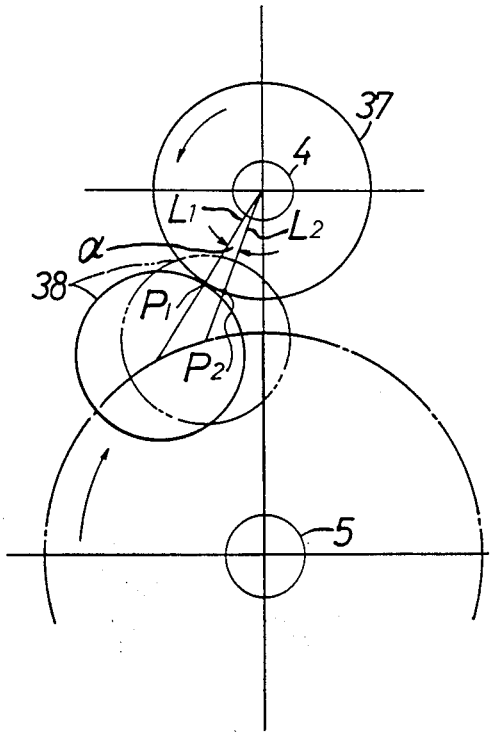

Next description will be made in detail of the operation of the cam mechanism 39. In FIG. 7, reference character $L_1$ shows a line of lifting action passing a lift beginning point $P_1$ of the release plate 37 by the release cam 38, $L_2$ a line of lifting action passing a lift ending point $P_2$ of the release plate 37 by the release cam 38, $\alpha$ an angle between the lines $L_1$ and $L_2$, and d a pitch diameter of the driven gear 10. An amount S of rotative displacement for giving a required amount x of lifting to the release plate 37 can be obtained by the following equation.

$$S = d \cdot \alpha / 360$$

Figure 8:
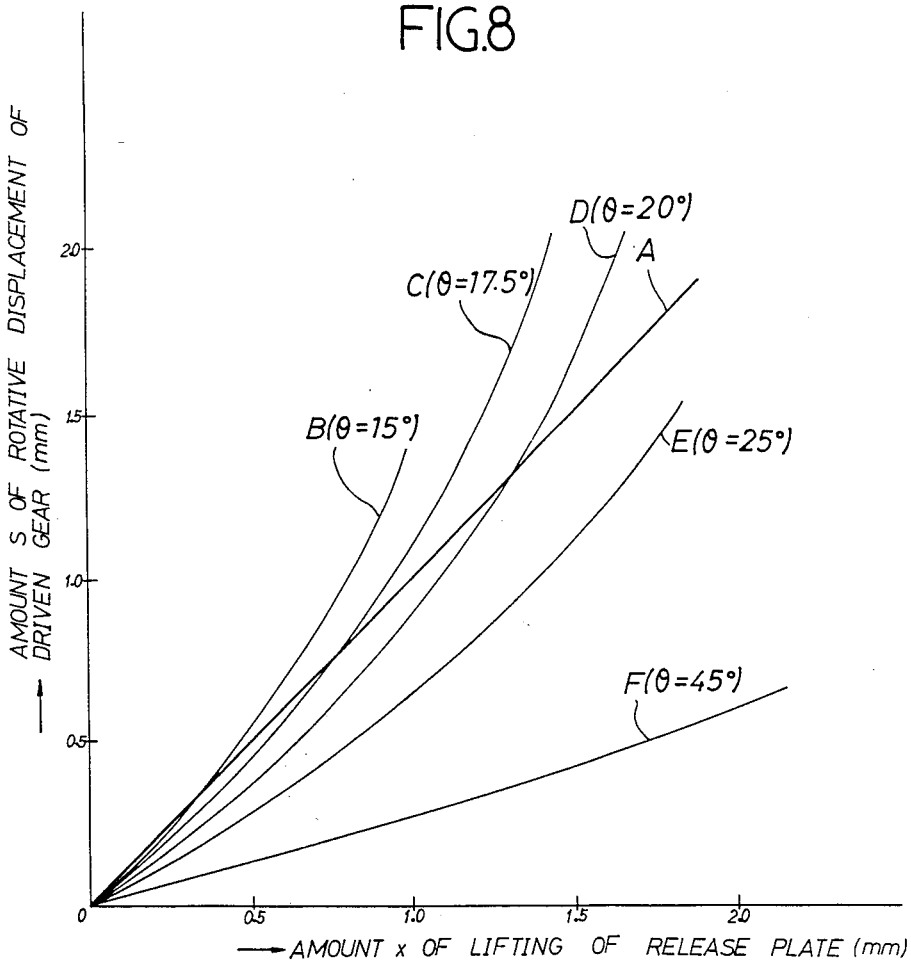

Using the above equation, there are obtainable as shown diagramatically and comparatively in FIG. 8 a curve A according to the present embodiment in which the cam surface 42 of the release cam 38 is formed as mentioned above and curves B, C, D, E and F in which an engaging angle $\theta$ of the release cam 38 with respect to the release plate 17 is set to 15°, 17.5°, 20° and 45°, respectively.

In all cases of these curves, a bevel angle of the driven gear 10 was set to 45° and the amount of lifting of the release plate 37 was set to 2 mm.

As will be obvious from FIG. 8, according to the characteristic A of the present embodiment, the amount x of lifting of the release plate 37 and the amount S of rotative displacement on the pitch circle of the driven gear 10 can be related to each other so as to have a proportion therebetween of substantially 1:1. In case of characteristics lower than the characteristic A, a large amount of lifting of the release plate 37 is obtained, but load imposed on the tooth surfaces of the driving and the driven gears 7, 10 becomes larger. In case of characteristics exceeding the characteristic A, the load on tooth surfaces is small, but there is a limit on its layout such that before lifting of the release plate 37 reaches the predetermined amount of 2 mm, the release cam 38 is disengaged from the release plate 37.

Therefore, according to the characteristic A of the third embodiment, the following advantages will be obtained.

(1) The amount x of lifting of the release plate 37 and the amount S of rotative displacement of the driven gear 10 balance with each other whereby the load on the tooth surfaces of the gears 7, 10 can be largely reduced.

(2) The engaging angle $\theta_1$ of the cam surface 42 at the lift beginning point $P_1$ of the release cam 38 can be made sufficient small so that the peak value of the load on the tooth surfaces can be lowered.

(3) From the above (2), with the peak value of the load on the tooth surfaces being lowered, once sliding motion is generated between the ratchets 11, 12 and between the gear 7, 10, frictions at their sliding portions change from static friction into dynamic friction. Accordingly, it makes it possible to lessen the total load necessary to lift the release plate 37 for the required amount in order to cause the driving ratchet 11 to disengage from the driven ratchet 12.

Therefore, in the third embodiment, much smoother disengagement of the driving ratchet 11 from the driven ratchet 12 can be realized.

What is claimed is:

1. A kick type starting device for an engine, comprising:

a kick axle provided with a kick pedal; a driving clutch body operatively connected to said kick axle so as to receive engaging thrust and rotary torque when said kick pedal is kicked; a driven clutch body provided on a crank shaft of the engine and engagable with said driving clutch body when the driving clutch body is advanced by said engaging thrust; and a cam mechanism including a release plate connected to said driving clutch body, and a disc-shaped release cam rotatably supported on said kick axle, said release cam coming into engagement with said release plate for disengaging said driving clutch body from said driven clutch body when said kick pedal returns to a resting position.

* * * * *